US007797802B2

(12) United States Patent
Ackerman

(10) Patent No.: US 7,797,802 B2
(45) Date of Patent: Sep. 21, 2010

(54) ACTUATING MEMBER FOR A CLOSURE ASSEMBLY AND METHOD

(75) Inventor: Bryan L. Ackerman, Freeland, MI (US)

(73) Assignee: S.C. Johnson & Son, Inc., Racine, WI (US)

( * ) Notice: Subject to any disclaimer, the term of this patent is extended or adjusted under 35 U.S.C. 154(b) by 526 days.

(21) Appl. No.: 11/998,302

(22) Filed: Nov. 29, 2007

(65) Prior Publication Data

US 2009/0139067 A1 Jun. 4, 2009

(51) Int. Cl.
*A44B 19/16* (2006.01)

(52) U.S. Cl. ..... 24/416; 24/427; 24/430; 383/64

(58) Field of Classification Search ..... None
See application file for complete search history.

(56) References Cited

U.S. PATENT DOCUMENTS

| | | | |
|---|---|---|---|
| 1,666,110 | A | 4/1928 | Statham |
| 2,867,877 | A | 1/1959 | Staller et al. |
| 2,875,491 | A | 3/1959 | Morin |
| 2,929,123 | A | 3/1960 | Schneideman |
| 3,074,137 | A | 1/1963 | Hawley |
| 3,103,049 | A | 9/1963 | Hawley |
| 3,115,689 | A | 12/1963 | Jacobs |
| 3,122,807 | A | 3/1964 | Ausnit |
| 3,172,443 | A | 3/1965 | Ausnit |
| 3,173,184 | A | 3/1965 | Ausnit |
| 3,220,076 | A | 11/1965 | Ausnit et al. |
| 3,324,520 | A | 6/1967 | Ausnit |
| 3,426,396 | A | 2/1969 | Laguerre |
| 3,430,329 | A | 3/1969 | Ausnit |
| 3,660,875 | A | 5/1972 | Gutman |
| 3,713,923 | A | 1/1973 | LaGuerre |
| 3,806,998 | A | 4/1974 | Laguerre |
| 3,959,856 | A | 6/1976 | Ausnit |
| 4,186,786 | A | 2/1980 | Kirkpatrick |
| 4,262,395 | A | 4/1981 | Kosky |
| 4,285,105 | A | 8/1981 | Kirkpatrick |
| 4,341,575 | A | 7/1982 | Herz |
| 4,363,345 | A | 12/1982 | Scheibner |
| 4,409,705 | A | 10/1983 | Yuunaga |
| 4,428,788 | A | 1/1984 | Kamp |
| 4,430,070 | A | 2/1984 | Ausnit |
| 4,513,484 | A | 4/1985 | Iblings |
| 4,541,117 | A | 9/1985 | Ashbeck |
| 4,778,282 | A | 10/1988 | Borchardt et al. |
| 4,812,056 | A | 3/1989 | Zieke |
| 4,817,188 | A | 3/1989 | Van Erden |
| 4,829,641 | A | 5/1989 | Williams |

(Continued)

FOREIGN PATENT DOCUMENTS

| | | |
|---|---|---|
| EP | 0 051 010 | 5/1982 |

(Continued)

*Primary Examiner*—Jack W. Lavinder

(57) ABSTRACT

A closure assembly with a slider is provided to open and close a resealable package. The closure assembly includes one or more pair of opposing interlocking profile elements and a rib optionally disposed between the interlocking profile elements of at least one side of the closure assembly. The slider includes opposing sidewalls and a top wall, with a separator member and a retention member extending from the top wall and closure members and hinged engagement members extending from the opposing sidewalls.

20 Claims, 8 Drawing Sheets

U.S. PATENT DOCUMENTS

| | | | |
|---|---|---|---|
| 4,907,321 | A | 3/1990 | Williams |
| 4,922,586 | A | 5/1990 | Robson |
| 4,929,225 | A | 5/1990 | Ausnit et al. |
| 4,944,072 | A | 7/1990 | Robson |
| 5,007,142 | A | 4/1991 | Herrington |
| 5,007,143 | A | 4/1991 | Herrington |
| 5,009,828 | A | 4/1991 | McCree |
| 5,010,627 | A | 4/1991 | Herrington et al. |
| 5,017,021 | A | 5/1991 | Simonsen et al. |
| 5,020,194 | A | 6/1991 | Herrington et al. |
| 5,063,644 | A | 11/1991 | Herrington et al. |
| 5,067,208 | A | 11/1991 | Herrington, Jr. et al. |
| 5,070,583 | A | 12/1991 | Herrington |
| 5,092,684 | A | 3/1992 | Weeks |
| 5,174,658 | A | 12/1992 | Cook et al. |
| 5,209,574 | A | 5/1993 | Tilman |
| 5,283,932 | A | 2/1994 | Richardson et al. |
| 5,301,394 | A | 4/1994 | Richardson et al. |
| 5,403,094 | A | 4/1995 | Tomic |
| 5,405,478 | A | 4/1995 | Richardson et al. |
| 5,442,837 | A | 8/1995 | Morgan |
| 5,442,838 | A | 8/1995 | Richardson et al. |
| 5,448,808 | A | 9/1995 | Gross |
| 5,509,734 | A | 4/1996 | Ausnit |
| 5,588,187 | A | 12/1996 | Swain |
| 5,664,299 | A | 9/1997 | Porchia et al. |
| 5,689,866 | A | 11/1997 | Kasai et al. |
| 5,722,128 | A | 3/1998 | Toney et al. |
| 5,729,876 | A | 3/1998 | Johnson |
| 5,775,812 | A | 7/1998 | St. Phillips et al. |
| 5,809,621 | A | 9/1998 | McCree et al. |
| 5,839,831 | A | 11/1998 | Mazzocchi |
| 5,867,875 | A | 2/1999 | Beck et al. |
| 5,871,281 | A | 2/1999 | Stolmeier et al. |
| 5,896,627 | A | 4/1999 | Cappel et al. |
| 5,947,603 | A | 9/1999 | Tilman |
| 5,953,796 | A | 9/1999 | McMahon et al. |
| 5,956,815 | A | 9/1999 | O'Connor et al. |
| 5,983,466 | A | 11/1999 | Petkovsek |
| 6,014,795 | A | 1/2000 | McMahon et al. |
| 6,036,364 | A | 3/2000 | Heuvel |
| 6,047,450 | A | 4/2000 | Machacek et al. |
| 6,088,887 | A | 7/2000 | Bois |
| 6,112,374 | A | 9/2000 | Van Erden |
| 6,178,722 | B1 | 1/2001 | McMahon |
| 6,220,754 | B1 | 4/2001 | Stiglic et al. |
| 6,257,763 | B1 | 7/2001 | Stolmeier et al. |
| 6,270,257 | B1 | 8/2001 | Yeager |
| 6,290,391 | B1 | 9/2001 | Buchman |
| 6,290,392 | B1 | 9/2001 | Sandor |
| 6,293,701 | B1 | 9/2001 | Tomic |
| 6,305,844 | B1 | 10/2001 | Bois |
| 6,361,209 | B1 | 3/2002 | LaRue et al. |
| 6,439,771 | B1 | 8/2002 | Herrington, Jr. |
| 6,477,821 | B1 | 11/2002 | Bois |
| 6,481,890 | B1 | 11/2002 | VandenHeuvel |
| 6,490,769 | B2 | 12/2002 | Siegel |
| 6,595,689 | B1 | 7/2003 | Borchardt et al. |
| 6,609,353 | B1 | 8/2003 | McMahon et al. |
| 6,609,827 | B2 | 8/2003 | Bois et al. |
| 6,611,996 | B2 | 9/2003 | Blythe et al. |
| 6,611,998 | B1 * | 9/2003 | Stiglic ..... 24/427 |
| 6,632,021 | B2 | 10/2003 | Bois et al. |
| 6,666,580 | B2 | 12/2003 | Bois |
| 6,691,383 | B2 | 2/2004 | Linton |
| 6,698,926 | B2 | 3/2004 | Buchman |
| 6,733,178 | B2 | 5/2004 | Bois |
| 6,739,755 | B2 | 5/2004 | Schreiter |
| 6,755,569 | B2 | 6/2004 | Bois |
| 6,761,481 | B1 | 7/2004 | Bois |
| 6,789,947 | B1 | 9/2004 | Kasai |
| 6,817,763 | B2 | 11/2004 | Tomic |
| 6,854,886 | B2 | 2/2005 | Piechocki et al. |
| 6,854,887 | B2 | 2/2005 | Anderson |
| 6,874,205 | B1 | 4/2005 | Savicki |
| 6,874,935 | B2 | 4/2005 | Edelman et al. |
| 6,880,972 | B2 | 4/2005 | Plourde |
| 6,883,210 | B1 | 4/2005 | Savicki |
| 6,896,409 | B2 | 5/2005 | Plourde et al. |
| 6,901,637 | B2 | 6/2005 | Machacek |
| 6,902,321 | B2 | 6/2005 | Bois |
| 6,915,546 | B2 | 7/2005 | Kasai |
| 6,951,421 | B2 | 10/2005 | Crunkleton et al. |
| 6,962,440 | B2 | 11/2005 | Fenzl et al. |
| 6,996,879 | B1 | 2/2006 | Savicki |
| 7,017,241 | B2 | 3/2006 | Bentsen |
| 7,036,987 | B2 | 5/2006 | Crunkleton et al. |
| 7,137,736 | B2 | 11/2006 | Pawloski et al. |
| 2003/0202718 | A1 | 10/2003 | Tomic |
| 2005/0008267 | A1 | 1/2005 | Linton et al. |
| 2005/0084183 | A1 | 4/2005 | Ausnit |
| 2006/0210201 | A1 | 9/2006 | Ackerman et al. |
| 2006/0265843 | A1 | 11/2006 | Ackerman |
| 2006/0269171 | A1 | 11/2006 | Turvey et al. |
| 2006/0282996 | A1 | 12/2006 | Ackerman et al. |
| 2007/0180668 | A1 | 8/2007 | Ackerman et al. |

FOREIGN PATENT DOCUMENTS

| | | |
|---|---|---|
| EP | 0 479 661 | 4/1992 |
| EP | 0 941 937 | 9/1999 |
| FR | 2 636 923 | 3/1990 |
| JP | 2001-247137 | 10/1989 |
| JP | 06-077518 | 11/1994 |
| JP | 7-51346 | 2/1995 |
| JP | 08-214920 | 8/1996 |
| JP | 10-503672 | 4/1998 |
| JP | 2000-023716 | 1/2000 |
| JP | 2000-152810 | 6/2000 |
| JP | 2002-128073 | 5/2002 |
| JP | 2004-161305 | 6/2004 |
| WO | WO 91/13759 | 9/1991 |
| WO | WO 92/17084 | 10/1992 |
| WO | WO 92/17086 | 10/1992 |
| WO | WO 92/19450 | 11/1992 |
| WO | WO 92/20252 | 11/1992 |
| WO | WO 99/62781 | 12/1999 |

* cited by examiner

ACTUATING MEMBER FOR A CLOSURE ASSEMBLY AND METHOD

BACKGROUND OF THE INVENTION

1. Field of the Invention

The present invention relates generally to apparatus, products, and methods associated with an elongate closure assembly for resealable packaging including an actuating member, such as a slider, operably disposed thereon.

2. Description of the Background of the Invention

Resealable packaging is a convenient and practical way to store a wide range of objects and materials. A resealable package, such as a pouch, having a pair of flexible walls that define an opening into an interior space, often includes a closure assembly positioned along a mouth of the package. The closure assembly often includes one or more sets of opposing, elongate, interlocking profile elements that extend between opposite ends of the mouth and engage each other when pressed together in one or more configurations.

In one instance, a closure assembly on a resealable package is sealed and unsealed by opening and closing a set of interlocking profiles in a pinch-and-seal manner by the fingers of a user. The user seals the resealable package by pressing together interlocking profiles—and unseals the package by pulling the profiles apart—with his or her fingers. The closure assembly has a first closure strip disposed on one package wall and a second strip disposed on an opposing package wall. Each of the first and second closure strips includes two parallel, spaced-apart interlocking profiles disposed between two bumper profiles, all of which extend from a same side of a backing flange.

Certain resealable packages may optionally include a slider to open and close the closure assembly. For example, another resealable package has a slider attached to a closure assembly having two pairs of interlocking profile elements to easily open and close the closure assembly. The slider has two opposing walls which close both pairs of interlocking profiles when the slider is slid in a closing direction along the closure assembly. The slider also has a separator member, or plow, extending downwardly between both pairs of interlocking profiles that opens both pairs of interlocking profiles when the slider is slid in an opening direction. Extending the plow between both pairs of interlocking profiles can create a gap or opening around the plow even when the slider is in a closed position on the closure assembly, which results in a non-continuous seal that may allow leaking of liquid, granular, or other contents held inside the package. A difficulty with resealable package closure assemblies including a slider is preventing leakage around the closure assembly, particularly at the closing end, because the plow, or other slider components, may impede the interlocking profile elements, preventing them from attaining an airtight closure of the package.

In a further instance, a slider for a double zipper closure assembly has a separator member that extends from a top wall of the slider to a location between an upper closure mechanism and a lower closure mechanism on a resealable package. A distal end of the separator member does not extend between the lower closure mechanism. Rather, a horizontal plate extends outwardly from opposite sides of the distal end of the separator member and presses outwardly on opposing sidewalls of the zipper closure assembly at a location between the upper and lower closure mechanisms. The horizontal plate is wide enough to force the lower closure mechanism apart by urging opposing sidewalls of the closure assembly apart. A docking area located at a closing end of the double zipper closure assembly includes a hole or slit through at least one of the opposing sidewalls so that the horizontal plate will extend through the hole or slit, thereby allowing the lower closure mechanism to remain closed at the closing end.

A further difficulty with resealable package closure assemblies arises when operably positioning a slider onto a resealable package closure assembly. Typical sliders are disposed over a closure assembly, yet have elements which fit between opposing interlocking profile elements to allow for opening and closing of the closure assembly. In some instances, the entirety of the walls of a slider is deformed to be positioned on a closure assembly. However, performing this action may cause a slider to lose some functionality should the deformation remain, and a slider not retain its original shape, after a slider is positioned on the closure assembly.

SUMMARY OF THE INVENTION

In one aspect of the invention, a slider for operatively engaging an elongate closure mechanism includes a body having a top and a side wall at least partly defining a channel for operatively receiving the elongate closure mechanism, and a retaining member extends downward from the top into the channel. A flexible member extends from a lower end of the side wall into an opening in the side wall. The flexible member has a free end proximate the top and a projection extending from the flexible member into the channel.

According to another aspect of the invention, a closure assembly includes a first elongate closure member including a first upper profile element spaced from a first lower profile element. A second elongate closure member includes a second upper profile element opposite the first upper profile element spaced from a second lower profile element opposite the first lower profile element. A slider includes a body having a top and a side wall, a retaining member extending from the top, and a flexible member having a projection. The flexible member extends from a lower end of the side wall and has a free end proximate the top; and the slider engages the first and second elongate closure members and is adapted to mate and unmate the first and second upper profile elements.

In a further aspect of the invention, a method of disposing an actuating member having a top and a side wall, a retaining member extending from the top, and a flexible member extending from a lower portion of the side wall opposite the retaining member onto a closure assembly having opposite elongate first and second closure profiles includes the steps of spacing apart the first and second closure profiles; urging the first closure profile between the side wall and the retaining member; urging the retaining member between upper interlocking elements of the first and second closure profiles; and moving the flexible member from a first position to a second position.

These and other features of the present invention will be more apparent from a consideration of the following detailed description, to be read in conjunction with the accompanying drawings, in which like reference numerals represent same or similar items.

DETAILED DESCRIPTION

Figure 1:
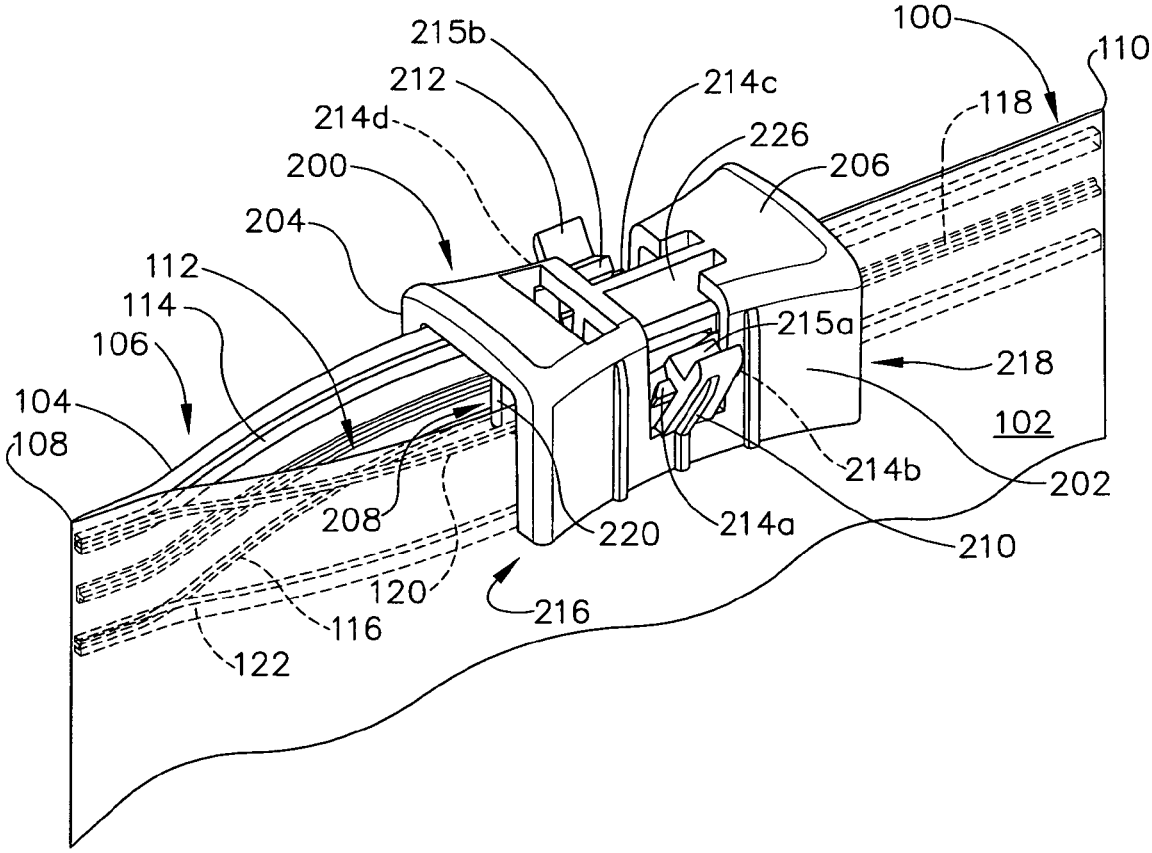
FIG. 1 is a partial isometric view of a resealable package with a closure assembly and a slider according to one embodiment of the present invention in a first position.

Referring now to FIGS. 1-6, a resealable package in the form of a pouch, such as a bag 100, has a pair of opposing sidewalls 102, 104 and an elongate closure assembly 106 disposed thereon, extending between an end 108 and an end 110 of the bag 100. The closure assembly 106 may be sealed, unsealed, and resealed to alternately close and open a mouth 112 of the bag 100. Upper and lower profile elements 114, 116, which are disposed in parallel along the sidewall 104, interlock with respective upper and lower profile elements 120, 122, which are disposed in parallel along the sidewall 102. Together, the profile elements 114, 116, 120, 122 are often referred to as a double zipper, with profile elements 114 and 120 collectively referred to as an upper zipper, and profile elements 116 and 122 collectively referred to as a lower zipper. In one embodiment, an elongate rib 118 extends substantially a length of the closure assembly 106, between the ends 108 and 110 along the sidewall 104, and spaced between the profile elements 114, 116. In one embodiment, the profile elements 114, 116 and 120, 122 are connected to top edges of the sidewalls 104, 102, respectively, to form the closure assembly 106. In other embodiments, the profile elements 114, 116 and 120, 122 may be extensions or integral parts of the sidewalls 104, 102, respectively, or may be connected to backing strips (not shown) which may subsequently be attached to the sidewalls 102, 104 of the bag 100.

Figure 2:
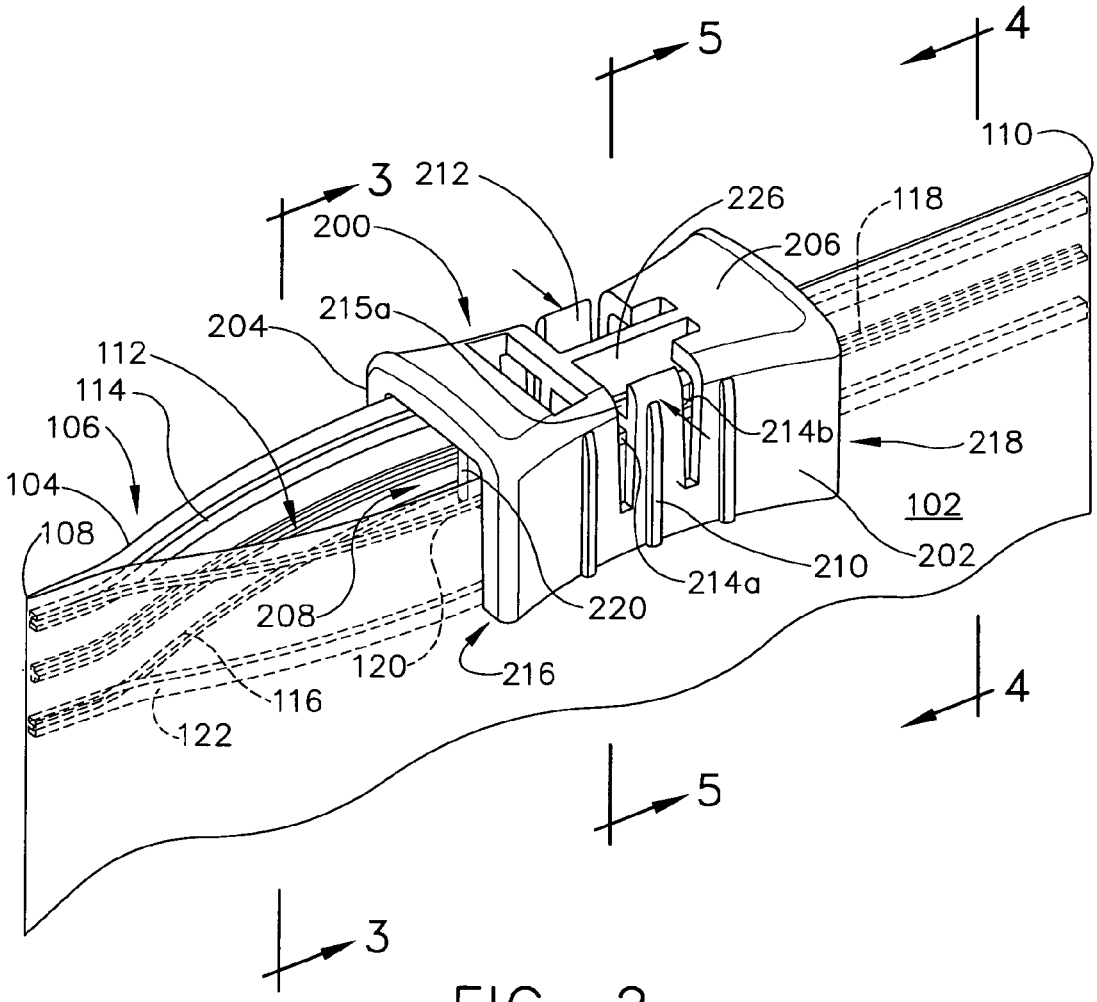
FIG. 2 is a partial isometric view of the resealable package with the slider of FIG. 1 in a second position.

A slider 200 is operably disposed on and engaged with the closure assembly 106. The slider 200 includes first and second opposing sidewalls 202, 204 extending downwardly from opposite edges of a top wall 206 and defining a channel 208 therebetween into which the closure assembly 106 is slidably accepted. As seen in FIG. 1, opposing flexible members 210, 212 defined in the sidewalls 202, 204, respectively, extend outwardly from the sidewalls 202, 204 and the channel 208, allowing the sidewalls 102, 104 of the bag 100 to be accepted into the channel 208. The flexible members 210, 212 include tabs 214*a*, 214*b* and 214*c*, 214*d*, respectively, which extend outwardly from opposite front and rear edges of the flexible members 210, 212 in a lateral direction a distance sufficient to be able to engage the respective sidewalls 202, 204. The flexible members 210, 212 also include inner surfaces, which may be embodied as projections 215*a*, 215*b*, respectively, extending into the channel 208. In one embodiment, as shown in FIGS. 1 and 2, each flexible member 210, 212 is located equidistant along the respective sidewall 202 or 204, between an end 216 and an end 218 of the slider 200.

Figure 3:
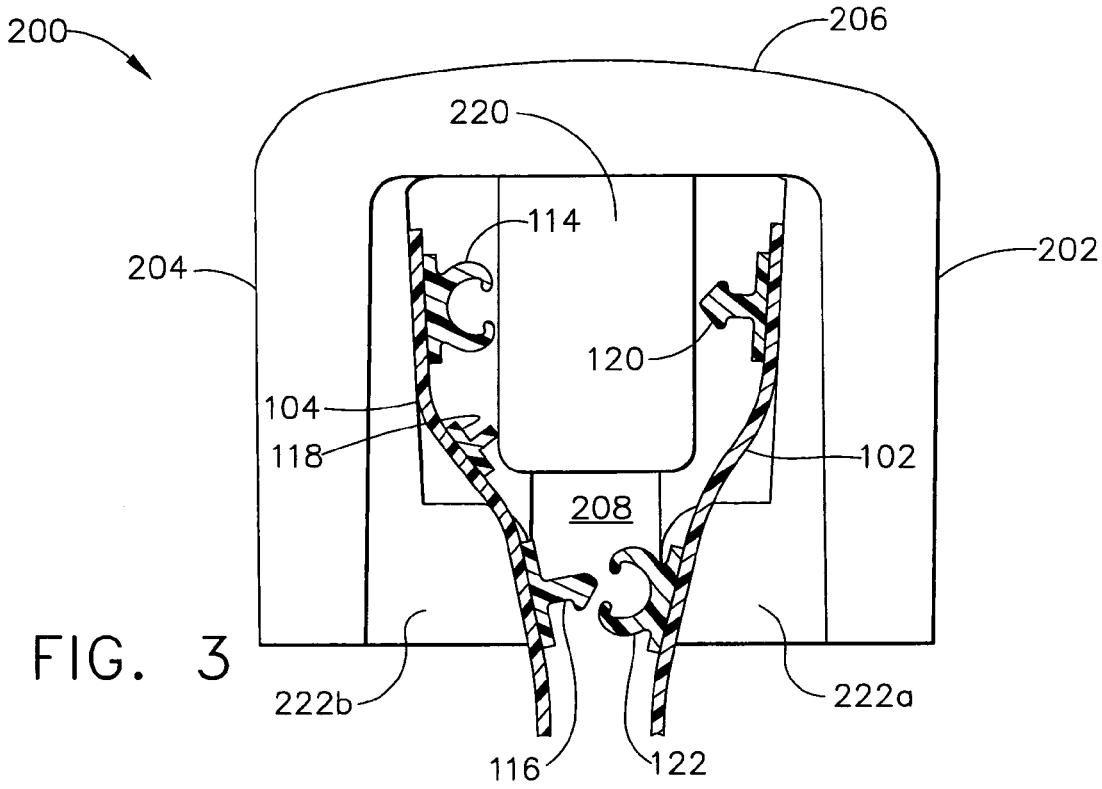
FIG. 3 is a partial cross-sectional view taken along line 3-3 of FIG. 2, with portions of the slider and the resealable package behind the plane of the cross-section omitted for clarity.

A separating member 220, best seen in FIG. 3, extends downwardly from the top wall 206 of the slider 200 into the channel 208, and when the slider 200 is operatively disposed on the bag 100, between the sidewalls 102, 104. The separating member 220 is also spaced between the sidewalls 202, 204 of the slider 200 adjacent the end 216, to allow the sidewalls 102, 104 and the upper zipper profile elements 114 and 120 to pass therebetween, as shown in FIG. 3. In one embodiment, the separating member 220 includes a wedge-shaped nose to aid in separation of the upper zipper (profile elements 114 and 120) during an opening operation of the slider 200. When the slider 200 is disposed on the bag 100, the separating member 220 also extends downwardly beyond and contacts the elongate rib 118. First closing members 222*a*, 222*b* extending from the sidewalls 202, 204, respectively, are disposed adjacent the opening end 216 behind the separating member 220. The first closing members 222*a*, 222*b* define a gap therebetween for accepting the closure assembly 106 and are adapted to engage and close the lower zipper (profile elements 116 and 122). When the slider 200 is urged along the closure assembly 106 in an opening direction, outwardly directed separation forces caused by the separating member 220 urge the sidewalls 102, 104 in opposite outward directions a distance sufficient to also simultaneously cause opening of the profile elements 116 and 122.

Figure 4:
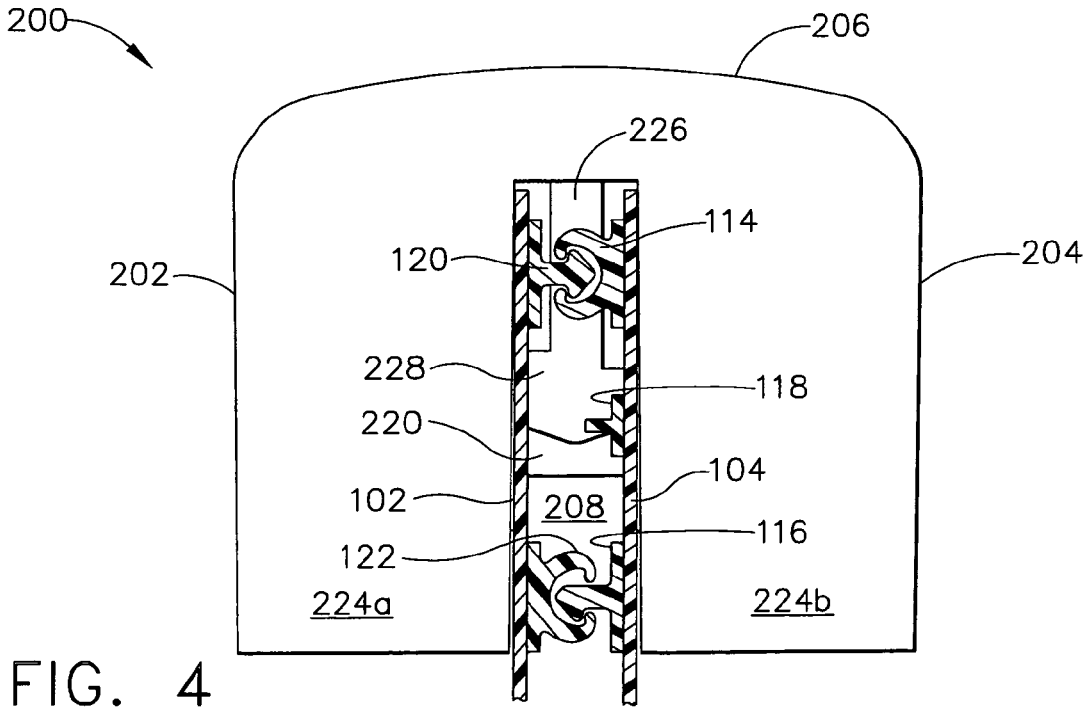
FIG. 4 is a partial cross-sectional view taken along line 4-4 of FIG. 2, with portions of the slider and the resealable package behind the plane of the cross-section omitted for clarity.
Figure 5:
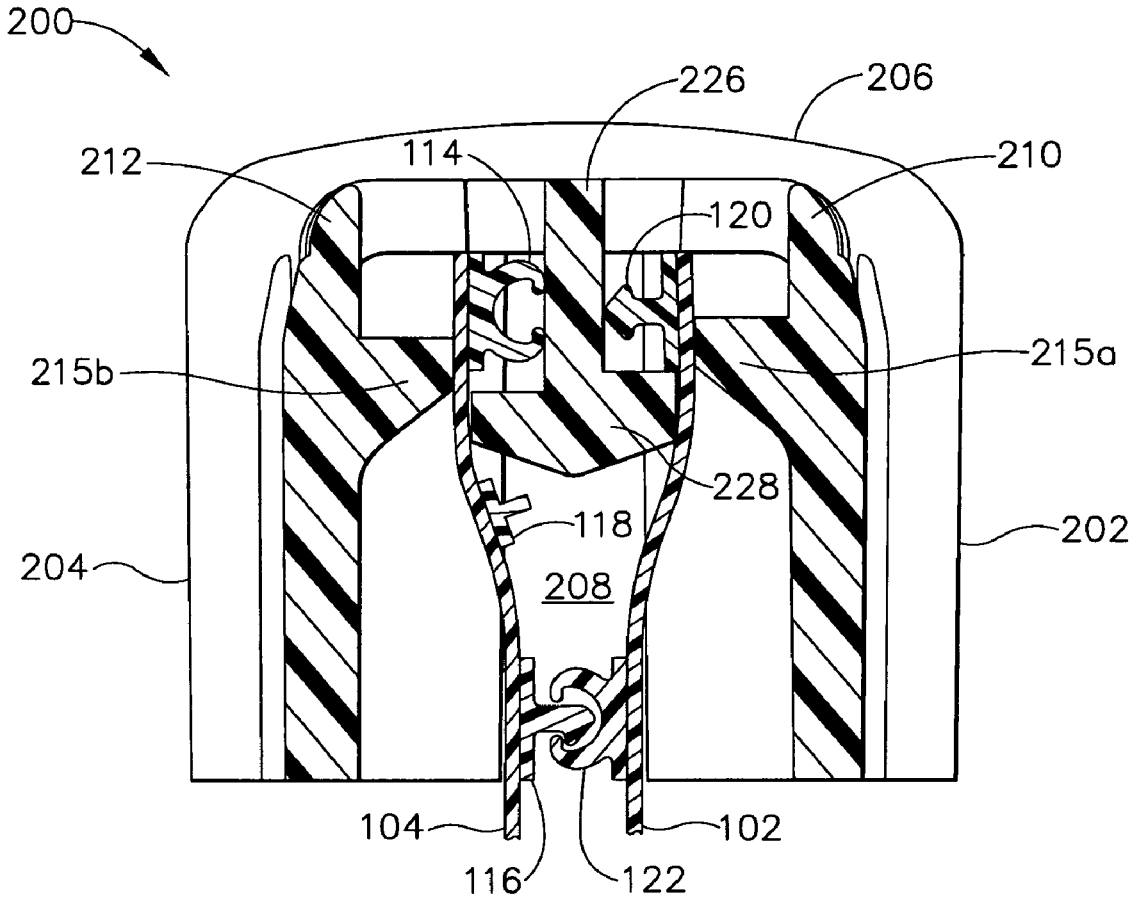
FIG. 5 is a partial cross-sectional view taken along line 5-5 of FIG. 2, with portions of the slider shown in phantom, and with portions of the slider and the resealable package behind the plane of the cross-section omitted for clarity.

As can best be seen in FIGS. 3-5, in one embodiment, profile elements 114 and 122 have groove-shaped, female interlocking cross-sections, the profile elements 116 and 120 have arrow-shaped, male interlocking cross-sections, and the elongate rib 118 has a T-shaped cross-section. In other embodiments, the specific shape, number and configuration of the individual profile elements and ribs may be altered without departing from the spirit and scope of the present invention. For example, the cross-sectional profile of the closure assembly 106 may include additional ribs and profile elements and/or may include profile elements with female interlocking cross-sections aligned on one sidewall of the bag 100 and profile elements with male interlocking cross-sections aligned on the opposite sidewall of the bag 100. The closure assembly 106 may include profile elements and ribs having symmetric or asymmetric cross-sectional profiles, in addition to being formed of numerous shapes capable of interlocking, including, but not limited to, C-shaped profiles, hooks, ovals, squares, triangles or other non-geometric shapes. In addition, the closure assembly 106 may be formed of thermoplastic, such as low-density polyethylene (LDPE), high density polyethylene (HDPE), linear low density polyethylene (LLDPE) or combinations thereof. For example, in one embodiment, the sidewalls of the resealable package are formed of a blend of HDPE, LDPE and LLDPE to be more rigid, and the profiles elements are formed of LDPE to be suppler.

In FIG. 4, second closing members 224*a*, 224*b* are shown adjacent the end 218 of the slider 200. The second closing members 224*a*, 224*b* extend into the channel 208 from the sidewalls 202, 204 and define a gap for accepting the closure assembly 106 there between. In the embodiment shown in FIG. 4, the second closing members 224*a*, 224*b* are adapted to engage and close both the upper zipper profile elements 114 and 120 and the lower zipper profile elements 116 and 122.

Figure 6:
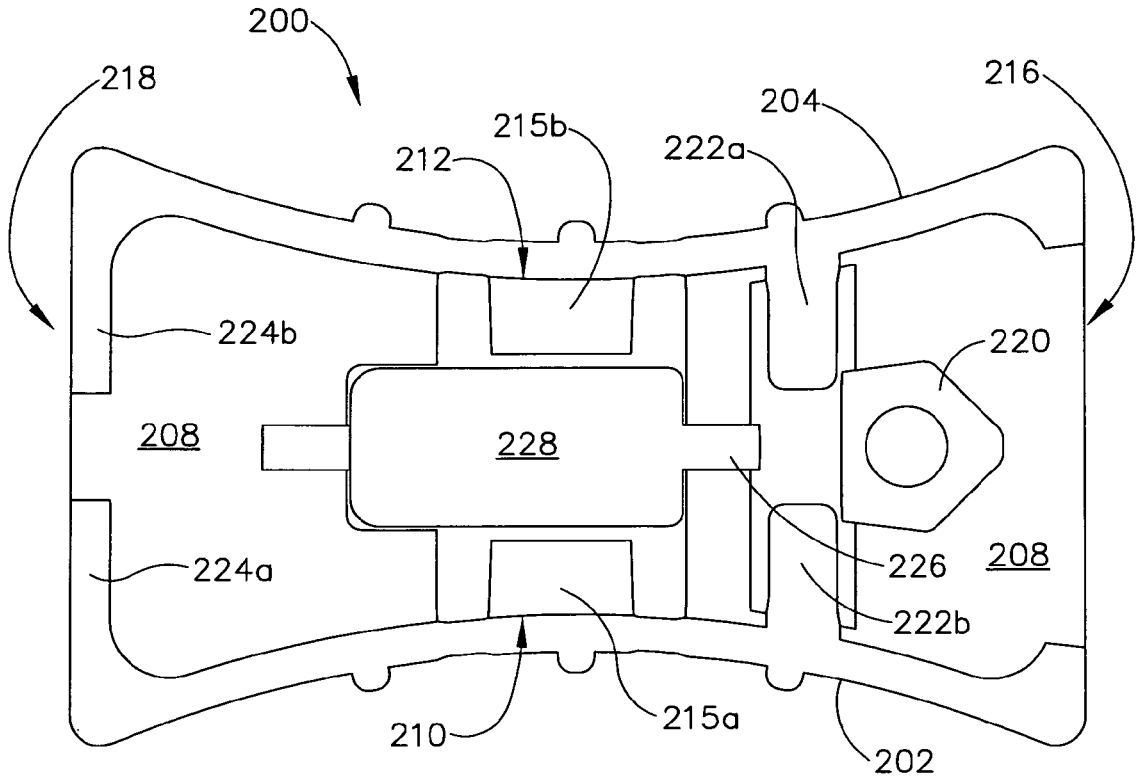
FIG. 6 is a bottom plan view of the slider of FIG. 1.

As best seen in FIGS. 5 and 6, a retaining member 226 extends downwardly from the top wall 206 and into the channel 208 between, and spaced from, the sidewalls 202, 204. The retaining member 226 includes a horizontal portion 228 spaced from the top wall 206. In one embodiment, when the slider 200 is disposed on the closure assembly 106, the retaining member 226 is disposed between the upper zipper profile elements 114 and 120 and the horizontal portion 228 engages a lower surface of at least one, and preferably both, of the upper zipper profile elements 114 and 120 to operably retain the slider 200 on the closure assembly 106. The flexible members 210, 212 may be moved inwardly, such as by being pinched between a user's fingers, which contact the upper zipper profile elements 114 and 120 at the respective inner surfaces of the flexible members 210, 212, which may be embodied as projections 215*a*, 215*b*, further retaining the upper zipper profile elements 114 and 120 in the space between the horizontal portion 228 and the top wall 206, as best seen in FIG. 5. In one embodiment, the horizontal portion 228 includes a rectangular plate that extends under the upper zipper profile elements 114 and 120. In other embodiments, the horizontal portion 228 may be configured differently, including incorporation of an elevation difference on opposite sides of the retaining member 226, as best seen in FIG. 5, for engaging profile elements 114 and 120 of numerous shapes and sizes. In yet further embodiments, the retaining member 226 may extend lower into the channel 208 and engage the optional elongate rib 118 or additional ribs that may be included to provide added retention of the slider 200 on the bag 100. Optionally, the top wall 206 of the slider 200 may include a plurality of windows or slots, as can be seen in FIGS. 1 and 2, aligned over and substantially coextensive with the retaining member 226.

When the flexible members 210, 212 are in the outwardly extending positions, as seen in FIG. 1, spaces created between the flexible members 210, 212 and the respective sidewalls 202, 204, the retaining member 226, and the horizontal portion 228, allow for clearance of the upper zipper profile elements 114 and 120, between the sidewalls 202, 204, as the slider 200 is disposed on the closure assembly 106 during construction of the bag 100. These spaces provide clearance to prevent or limit any undesirable deformation of the sidewalls 202, 204 or top wall 206 of the slider 200 during construction.

After the slider 200 is engaged with the bag 100, as first seen in FIG. 1, each flexible member 210, 212 is pivoted about a base thereof inwardly toward the channel 208 to align with its respective sidewall 202, 204, with each flexible member 210, 212 attached to or extending from a lower portion of its respective sidewall 202, 204. The tabs 214*a*, 214*b* on flexible member 210 and the tabs 214*c*, 214*d* on flexible member 212 are designed to snap into locked positions adjacent to, or against interior surfaces of, the respective sidewalls 202, 204, as seen in FIG. 2 and again in FIG. 5, thereby securing the inner surfaces of the flexible members 210, 212, which may be embodied as projections 215*a*, 215*b*, in a position disposed against the upper zipper profile elements 114 and 120 above the horizontal portion 228 of the retaining member 226, preventing the flexible members 210, 212 from returning to the outwardly extending positions shown in FIG. 1.

Figure 7:
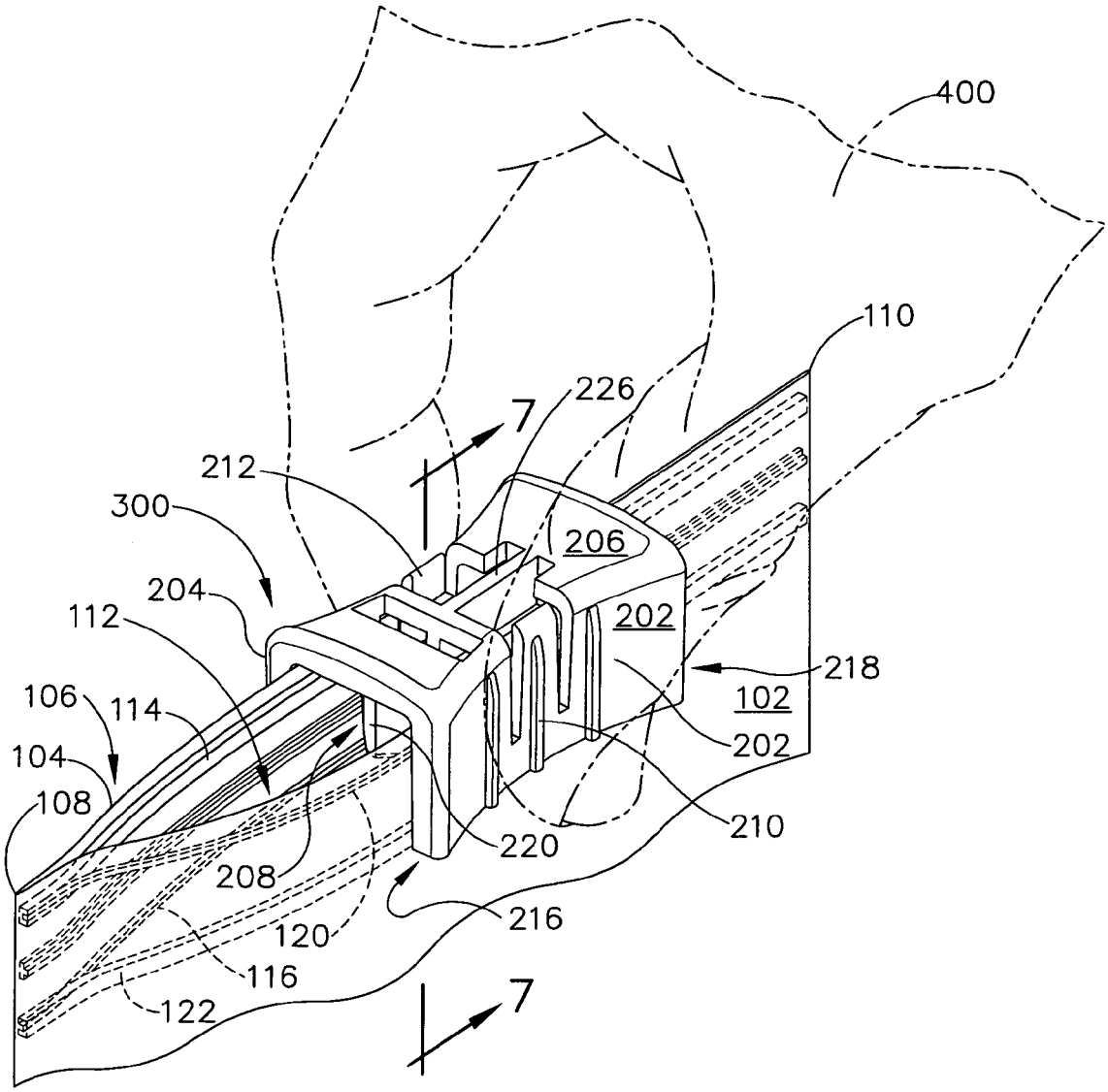
FIG. 7 is a partial isometric view of a resealable package with a closure assembly and a slider according to another embodiment of the present invention.
Figure 8:
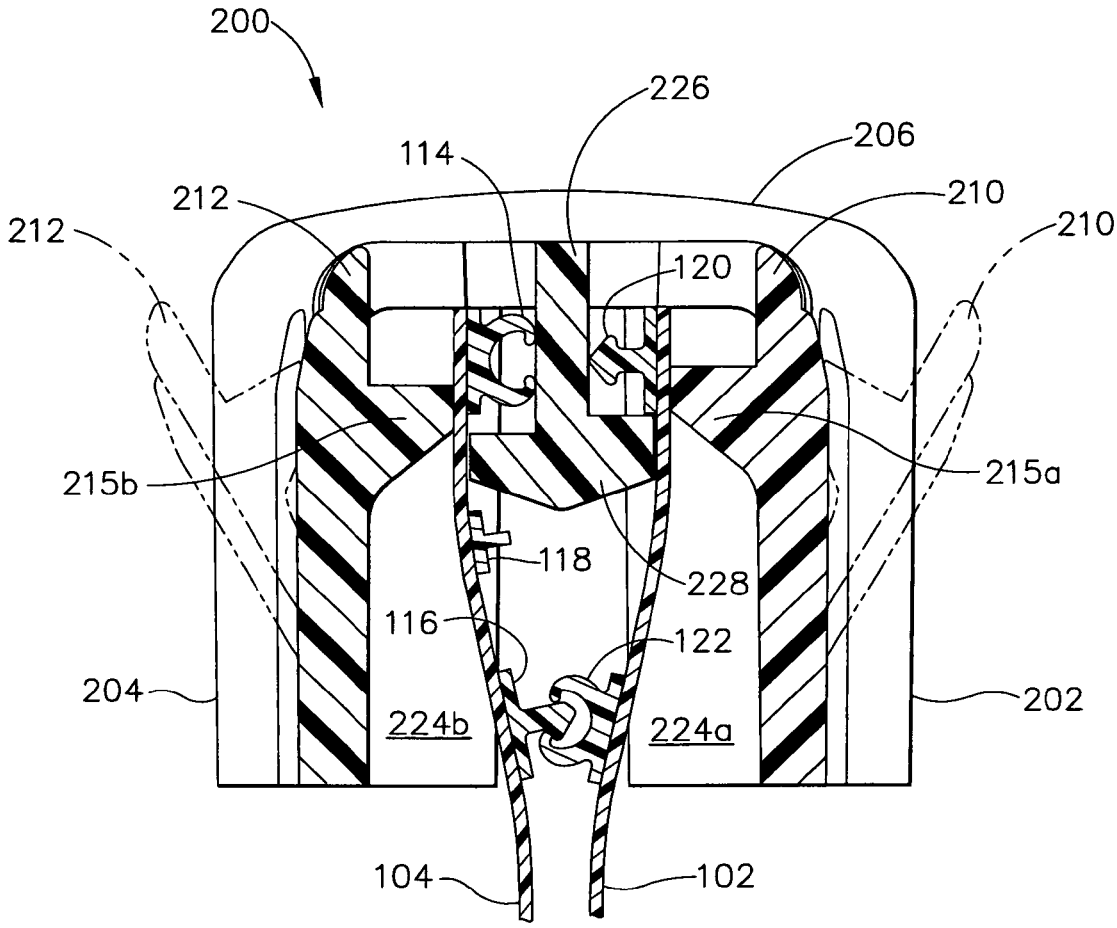
FIG. 8 is a partial cross-sectional view taken along line 7-7 of FIG. 7, with portions of the slider and the resealable package behind the plane of the cross-section omitted for clarity.
Figure 9:
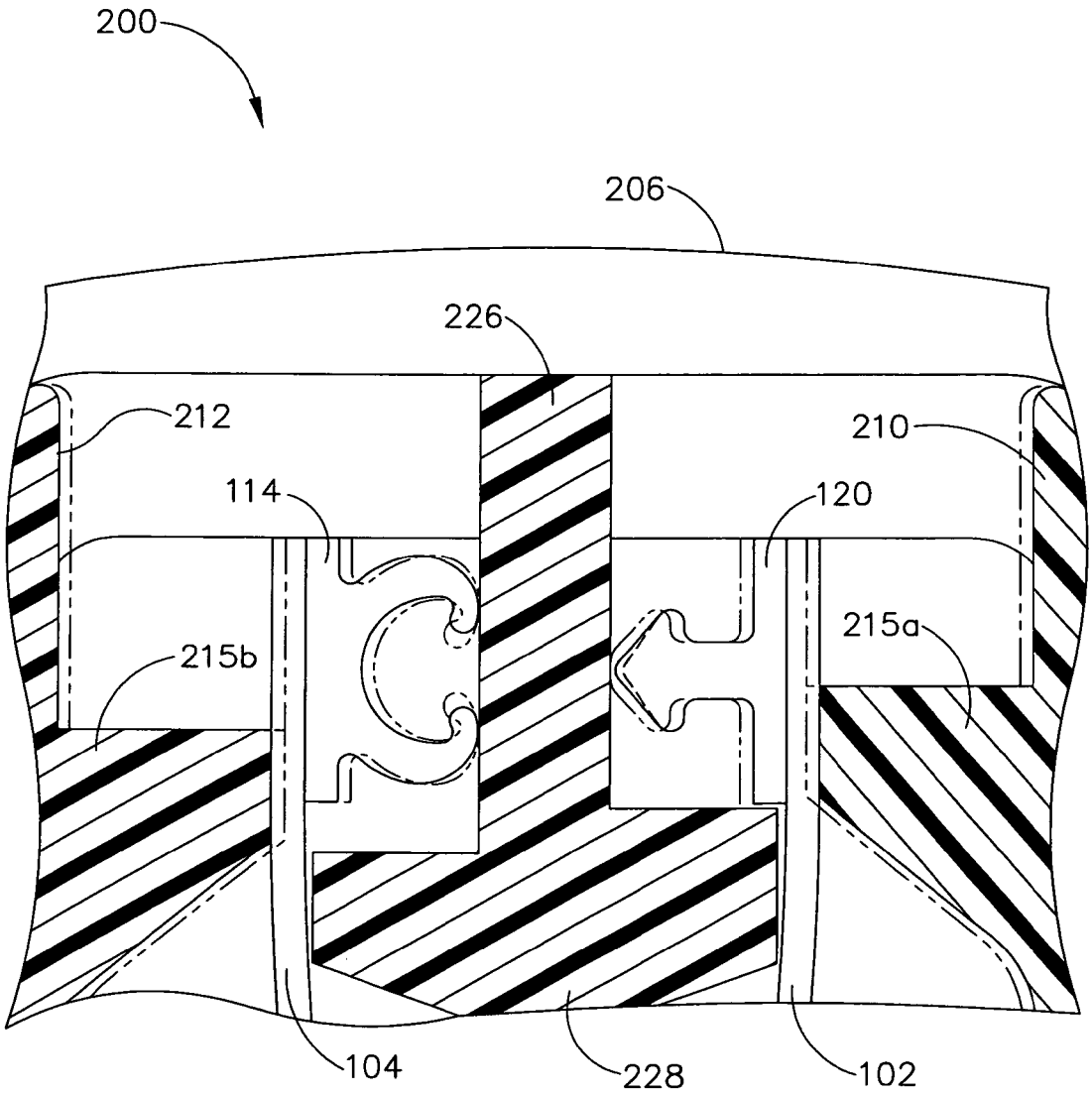
FIG. 9 is an enlarged view of FIG. 8, showing movement of a portion of the closure assembly in relation to flexible members on the slider.

Referring now to FIGS. 7-9, in another embodiment, a slider 300 is generally similar to the slider 200, except that the tabs 214*a-d* are absent from the flexible members 210 and 212. The flexible members 210, 212 in this embodiment are normally in alignment with the respective sidewalls 202, 204 and may be resiliently flexed both outwardly and inwardly and will return to the aligned position when not being urged inwardly or outwardly. As the slider 300 is engaged with the bag 100, each flexible member 210, 212 is flexed about a base thereof outwardly away from the channel 208, pushed by the bag 100. After the slider 300 is engaged with the bag 100, the flexible members 210, 212 resiliently flex inwardly toward the channel 208 to align with the respective sidewalls 202, 204.

As shown in FIG. 7, as the slider 300 is moved by a user 400 from the end 110 toward the end 108 of the bag 100, the mouth 112 of the bag 100 is closed by urging together the upper zipper profile elements 114 and 120 and the lower zipper profile elements 116 and 122. In the embodiment shown, during a closing movement of the slider 300 along the closure assembly 106 from the end 110 toward the end 108, unengaged portions of the upper zipper profile elements 114 and 120 are caused to pass into the channel 208, along opposite sides of the separating member 220, then along opposite sides of the retaining member 226 above the horizontal portion 228. Thereafter, the upper zipper profile elements 114 and 120 pass through the gap between the second closing members 224*a*, 224*b* and the profile elements 114 and 120 are engaged together, so that, after passing through the gap, the profile elements 114 and 120 are interlocked and closed. During the same closing movement, unengaged portions of the lower zipper profile elements 116 and 122 are caused to pass into the channel 208, through the gap between the first closing members 222*a*, 222*b* where the profile elements 116 and 122 are engaged together, then through the gap between the second closing members 224*a*, 224*b*, where the lower profile elements 116 and 122 are interlocked and closed.

During an opening movement, as the slider 300 is moved from the end 108 of the closure assembly 106 toward the end 110, the mouth 112 of the bag 100 is opened by urging apart the upper zipper profile elements 114 and 120 and the lower zipper profile elements 116 and 122. The opening of the closure assembly 106 by movement of the slider 300 occurs in reverse of that which is described above for the closing of the closure assembly 106.

As shown in dashed lines in FIG. 8, the flexible members 210, 212 in an outward position are moved to a position located inwardly of the sidewalls 202, 204 of the slider 300, such as by pivoting the flexible members 210, 212 about a base portion of the respective sidewalls 202, 204, to aid in retention of the upper zipper profile elements 114 and 120 through contact of the sidewalls 102, 104 of the bag 100 with inner surfaces of the flexible members 210, 212, such as projections 215*a*, 215*b*. As the user 400 (such as is shown in FIG. 7) contacts the flexible members 210, 212, the inner surfaces of the flexible members 210, 212, shown in FIG. 7 as projections 215*a*, 215*b*, are pushed to a position adjacent the retaining member 226, above the horizontal portion 228, with the sidewalls 102, 104 of the bag disposed in between, as shown in detail in FIG. 9. This contact of the inner surfaces of the flexible members 210, 212, shown by projections 215*a*, 215*b*, aids in further retaining the upper zipper profile elements 114 and 120 on the slider 300. The above-described opening and closing movements of the slider 300 apply equally to the slider 200, except that with tabs 214*a-d*, the flexible members 210, 212 of the slider 200 will be retained in a position adjacent an inner surface of the sidewalls 202, 204 once the user 400 pushes the flexible members 210, 212 of the slider 200 past the sidewalls 202, 204 and the tabs 214*a-d* snap into place.

In one embodiment of the bag 100, one or both of the profile elements 114 and 120 of the upper zipper and/or the profile elements 116 and 122 of the lower zipper may include undulations, breaks, or changes in cross-sectional profile along a specified length thereof to create an effect of tactile or sound vibrations as the profile elements engage or disengage one another. Additionally, as the user 400 would open or close the closure assembly 106 of the bag 100 and press against the flexible members 210, 212 of the slider 200 or 300, the varying shape of the cross-sectional profiles of the profile elements would contact the retaining member 226, forcing the flexible members 210, 212 in varying outward and inward directions corresponding to the varying dimensions of the profile elements, providing a tactile response indicating movement to the user 400 pressing against the flexible members 210, 212.

Each of the sliders 200 and 300 illustrated and described may be engaged with a closure assembly including a double zipper, such as the closure assembly 106. It is contemplated that the parts and features of any one of the embodiments described can be interchanged with the parts and features of any other of the embodiments without departing from the spirit of the invention. The foregoing description of the invention discloses and describes merely exemplary embodiments of the present invention and is not intended to be exhaustive or to limit the invention to the precise form disclosed. As will be understood by those skilled in the art, the invention may be embodied in other specific forms, or modified or varied in light of the above teachings, without departing from the spirit, novelty or essential characteristics of the present invention. Accordingly, the disclosure of the present invention is intended to be illustrative, but not limiting, of the scope of the invention, which is set forth in the following claims.

What is claimed is:

1. A slider for operatively engaging an elongate closure mechanism, the slider comprising:

a body having a top and a side wall at least partly defining a channel for operatively receiving the elongate closure mechanism;

a retaining member extending downwardly from the top into the channel;

a flexible member extending upwardly from a lower end of the side wall into an opening in the side wall, wherein the flexible member has a free end proximate the top; and an inner surface of the flexible member extending into the channel.

2. The slider of claim 1, wherein the flexible member flexes about the lower end of the side wall opposite the top.

3. The slider of claim 2, wherein the flexible member includes a tab adapted to lockingly engage the side wall.

4. The slider of claim 1, wherein the retaining member is spaced from the side wall.

5. The slider of claim 1, wherein the retaining member includes a horizontal portion extending toward the side wall.

6. The slider of claim 5, wherein the inner surface of the flexible member comprises a projection, and wherein the horizontal portion and the projection are at least partly longitudinally aligned.

7. The slider of claim 5, wherein the projection is at least partly disposed between the horizontal portion and the top.

8. The slider of claim 3, wherein the flexible member flexes between a first position wherein the flexible member is angled outwardly from, and the tab is not lockingly engaged with, the side wall, and a second position wherein the flexible member is angled inwardly to, and the tab is lockingly engaged with, the side wall.

9. The slider of claim 8, wherein, in the second position, the opening in the side wall defines first and second slots.

10. The slider of claim 1, wherein the top defines an opening adjacent the free end of the flexible member.

11. The slider of claim 1, further comprising a separating member extending from the top wall and disposed adjacent an opening end of the slider, wherein the retaining member is disposed between the separating member and a closing end of the slider, and wherein the slider includes a first closing member adjacent an opening end of the slider and a second closing member disposed between the first closing member and the separating member, and wherein the opening in the side wall is defined longitudinally between the opening end and the closing end.

12. A closure assembly, comprising:

a first elongate closure member including a first upper profile element spaced from a first lower profile element;

a second elongate closure member including a second upper profile element opposite the first upper profile element spaced from a second lower profile element opposite the first lower profile element; and a slider including a body having a top and a side wall, a retaining member extending downwardly from the top and including a portion extending laterally underneath at least one of the upper profile elements, and a flexible member having an inner surface, wherein the flexible member extends upwardly from a lower end of the side wall and has a free end proximate the top;

wherein the slider engages the first and second elongate closure members and is adapted to mate and unmate the first and second upper profile elements.

13. The closure assembly of claim 12, wherein the top and side wall of the slider at least partly define a channel, and wherein the first and second elongate closure members are operatively received within the channel.

14. The closure assembly of claim 13, wherein the inner surface of the flexible member extends into the channel.

15. The closure assembly of claim 14, wherein the flexible member includes a tab adapted to secure against the side wall.

16. The closure assembly of claim 13, wherein a separating member is disposed adjacent an opening end of the slider, and wherein the slider includes a first closing member adjacent a closing end of the slider opposite the opening end and a second closing member disposed between the first closing member and the separating member, and wherein the second closing member is adapted to mate the first and second lower profile elements.

17. The closure assembly of claim 16, wherein the retaining member is disposed between the first and second upper profile elements, and wherein the flexible member urges at least one of the first and second upper or lower profile elements when flexed inwardly, and wherein a rib extends along the closure assembly and is disposed between the first upper and first lower profile elements of the first elongate closure member, and wherein the separating member impacts the rib.

18. A method of disposing an actuating member having a top and a side wall, a retaining member extending from the top, and a flexible member extending from a lower portion of the side wall opposite the retaining member onto a closure assembly having opposite elongate first and second closure profiles, the method comprising the steps of:

spacing apart the first and second closure profiles of the closure assembly;

urging the first closure profile between the side wall and the retaining member of the actuating member;

urging the retaining member between upper interlocking elements of the first and second closure profiles; and moving the flexible member from a first position to a second position.

19. The method of claim 18, further comprising the step of moving the flexible member back to the first position, wherein, in the first position, the flexible member is aligned with the side wall, and wherein, in the second position, the flexible member is spaced outward from the side wall and is disposed against the closure assembly.

20. The method of claim 18, wherein the flexible member includes a tab, and wherein, in the first position, the flexible member is spaced outward from the side wall, and wherein, in a second position, the flexible member is aligned with the side wall with the tab secured adjacent the side wall, wherein the flexible member is disposed against the closure assembly.

* * * * *